US007396056B2

(12) United States Patent
Cheng

(10) Patent No.: US 7,396,056 B2
(45) Date of Patent: Jul. 8, 2008

(54) CHILDPROOF GATE LOCK

(76) Inventor: Shu-Chen Cheng, 10F, No. 29-5, Sec. 2, Chung Cheng E. Rd., Tamshui Chen, Taipei Hsien (TW)

( * ) Notice: Subject to any disclaimer, the term of this patent is extended or adjusted under 35 U.S.C. 154(b) by 258 days.

(21) Appl. No.: 11/252,841

(22) Filed: Oct. 18, 2005

(65) Prior Publication Data

US 2007/0085353 A1 Apr. 19, 2007

(51) Int. Cl.
*E05B 15/02* (2006.01)
*E05C 1/08* (2006.01)

(52) U.S. Cl. ..... 292/341.15; 292/163

(58) Field of Classification Search ..... 292/DIG. 29, 292/340, 341.15, 341.17, 137, 163, 150, 292/146, 67, 4, 5, 203, 207, 210, DIG. 63, 292/DIG. 64; 49/394, 465; 403/321, 322.1, 403/322.4; 70/379 R, 380
See application file for complete search history.

(56) References Cited

U.S. PATENT DOCUMENTS 487,153 A * 11/1892 Orth ..... 70/156
1,505,023 A * 8/1924 Hench ..... 24/635
4,239,269 A * 12/1980 Chiang ..... 292/175
4,530,528 A * 7/1985 Shamie ..... 292/60
5,042,854 A * 8/1991 Huang ..... 292/175
5,146,632 A * 9/1992 Li ..... 5/100
5,432,962 A * 7/1995 Huang ..... 5/100
5,560,660 A * 10/1996 Tserng ..... 292/341.17
5,638,885 A * 6/1997 Freese et al. ..... 160/371
6,357,075 B1 * 3/2002 Kaizuka ..... 15/207.2
6,499,254 B2 * 12/2002 Rossman et al. ..... 49/55
6,536,163 B1 * 3/2003 Monahan et al. ..... 49/465
2005/0062293 A1 * 3/2005 Shen et al. ..... 292/137

* cited by examiner

*Primary Examiner*—Patricia Engle
*Assistant Examiner*—Alyson M Merlino
(74) *Attorney, Agent, or Firm*—William E. Pelton, Esq.; Cooper & Dunham LLP

(57) ABSTRACT

A gate lock is composed of a lock base, a lock core with a slot defined therein, a latch member and a bolt assembly. A gate is mounted in a frame, which can be mounted in a doorway. The gate lock is mounted on the gate and the bolt assembly of the gate lock is mounted on the frame. When the gate is closed, the bolt is engaged in the slot in the lock core. The lock core is then rotated 90 degrees. The bolt will not slide out of the slot, and the gate is locked. To unlock the gate, the lock core is rotated 90 degrees in the opposite direction. The gate is then lifted upward allowing the bolt to slide out of the slot, thus enabling the gate to swing open.

9 Claims, 9 Drawing Sheets

CHILDPROOF GATE LOCK

BACKGROUND OF THE INVENTION

1. Field of the Invention

The present invention relates to a gate lock, and particularly relates to a gate lock mounted on a gate or barrier to prevent children or pets from getting out.

2. Description of the Related Art

Little children normally lack an awareness of danger. They may wander out of a room or a home without parents noticing. Pets can also get out easily if there are no restrictions. Gates or barriers are usually mounted in doorways to prevent small children or pets from getting out.

However, the gates are usually secured with simple latches or locking devices, which can be easily opened by some smart children, thus rendering the gates ineffective in protecting children or pets.

Therefore, the invention provides a gate lock to mitigate or obviate the aforementioned problems.

SUMMARY OF THE INVENTION

The main objective of the present invention is to provide a gate lock that is childproof. A gate lock in accordance with the present invention is composed of a lock base, a lock core with a slot defined therein, a latch member and a bolt assembly.

A gate is mounted in a frame, which can be mounted in a doorway. The gate lock is mounted on the gate and the bolt assembly of the gate lock is mounted on the frame. When the gate is closed, the bolt is engaged in the slot in the lock core. The lock core is then rotated 90 degrees. The bolt will not slide out of the slot, and the gate is locked. To unlock the gate, the lock core is rotated 90 degrees in the opposite direction. The gate is then lifted upward allowing the bolt to slide out of the slot, thus enabling the gate to swing open. The design of this invention has two locking mechanisms that can lock the gate more securely and safely than the prior art.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
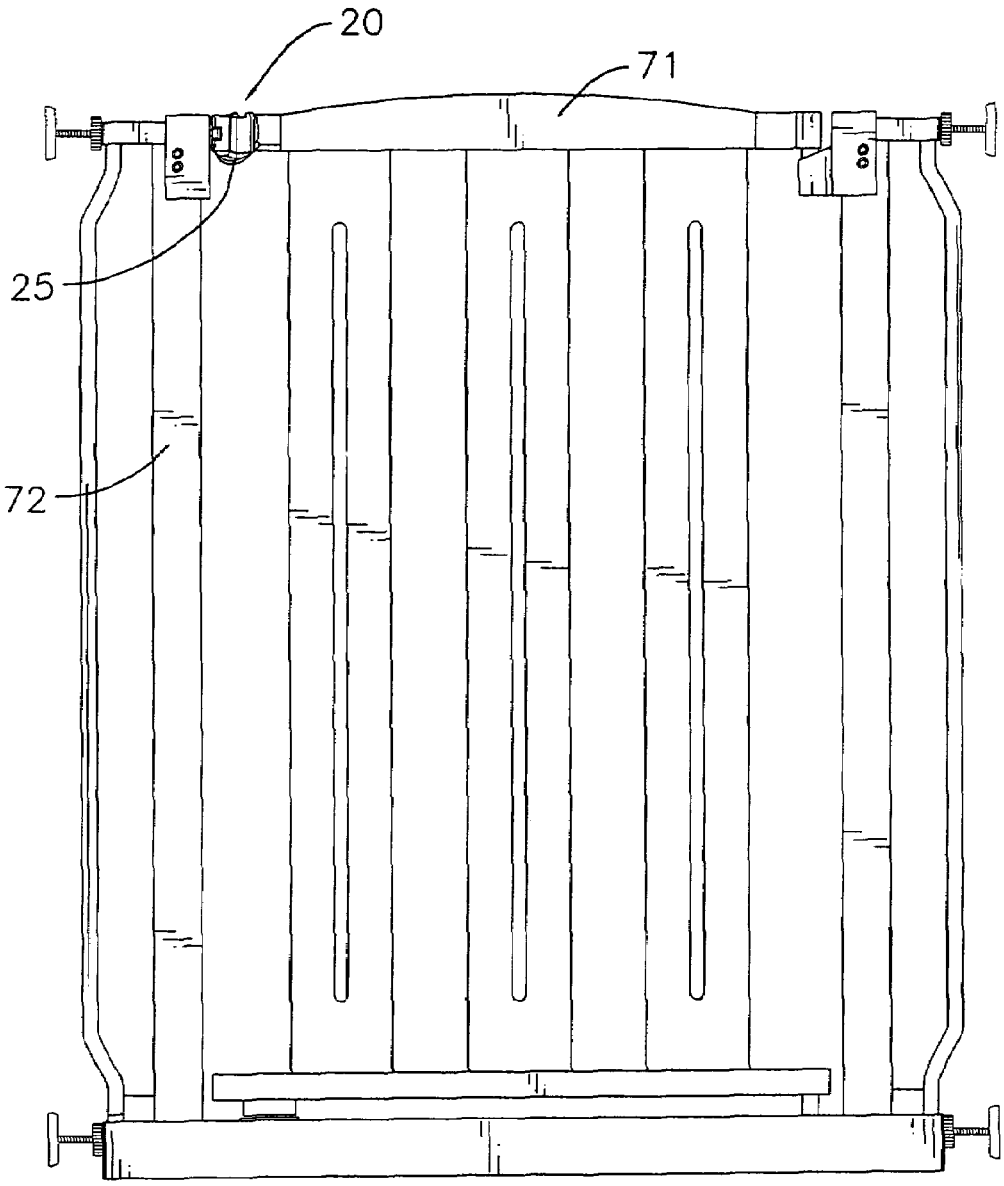
FIG. 1 is a front view of a gate lock in accordance with this invention mounted on a gate and frame.
Figure 2:
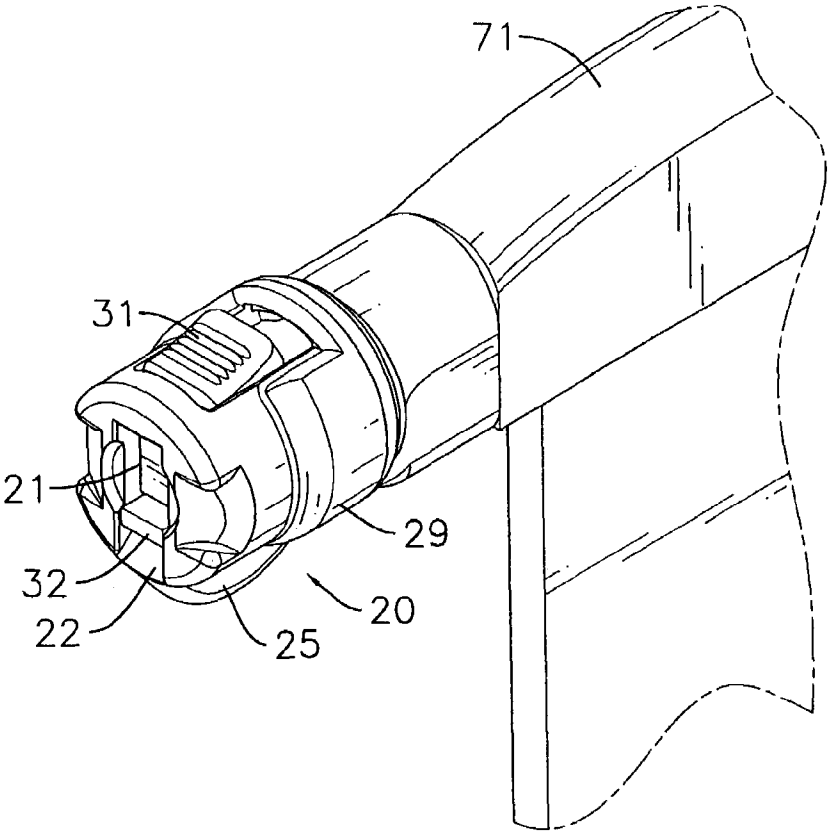
FIG. 2 is an enlarged perspective view of the gate lock in accordance with this invention.
Figure 3:
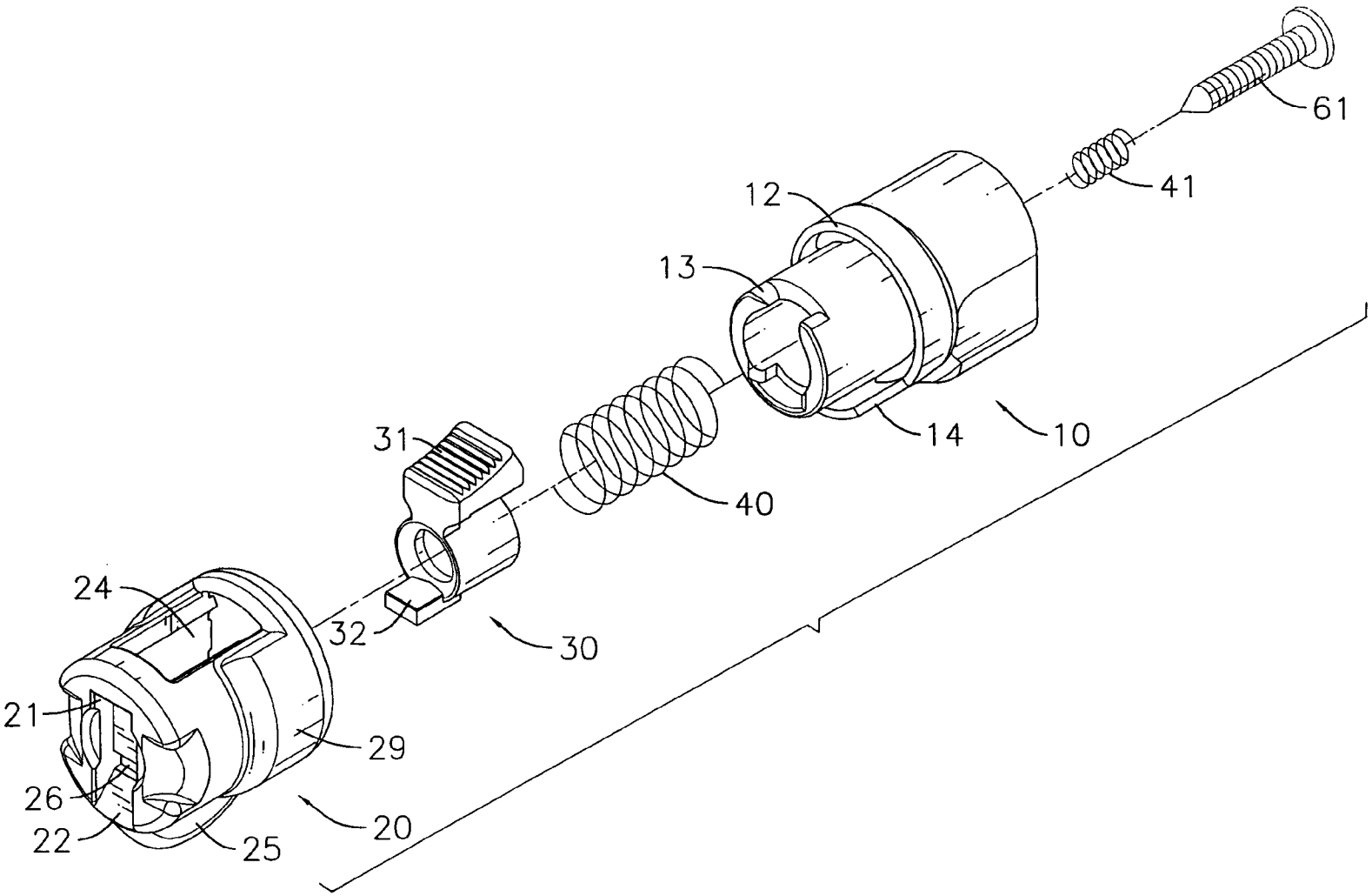
FIG. 3 is an exploded perspective view of the gate lock in FIG. 2.
Figure 4:
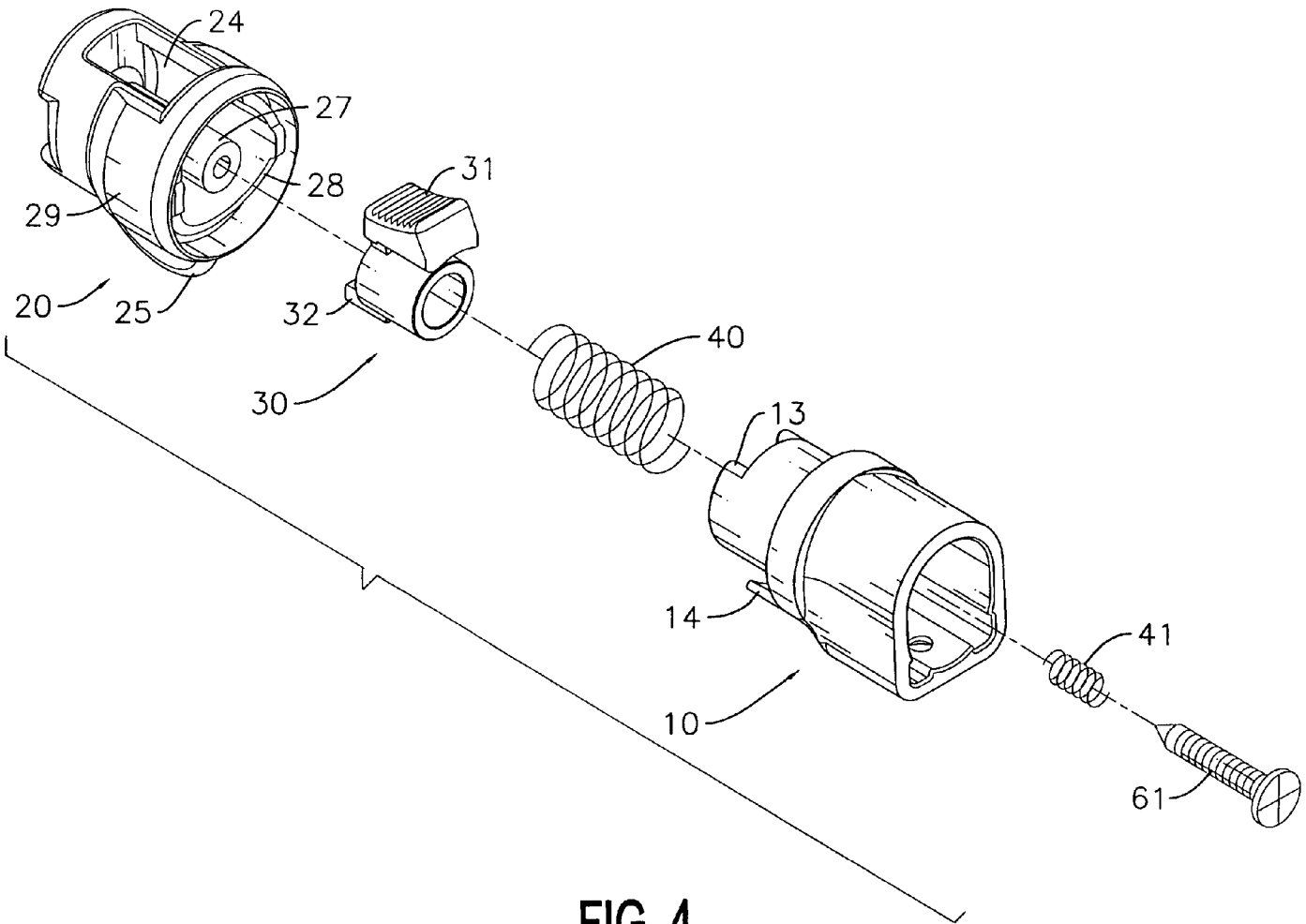
FIG. 4 is an exploded perspective view of the gate lock in FIG. 2 from another angle.
Figure 5:
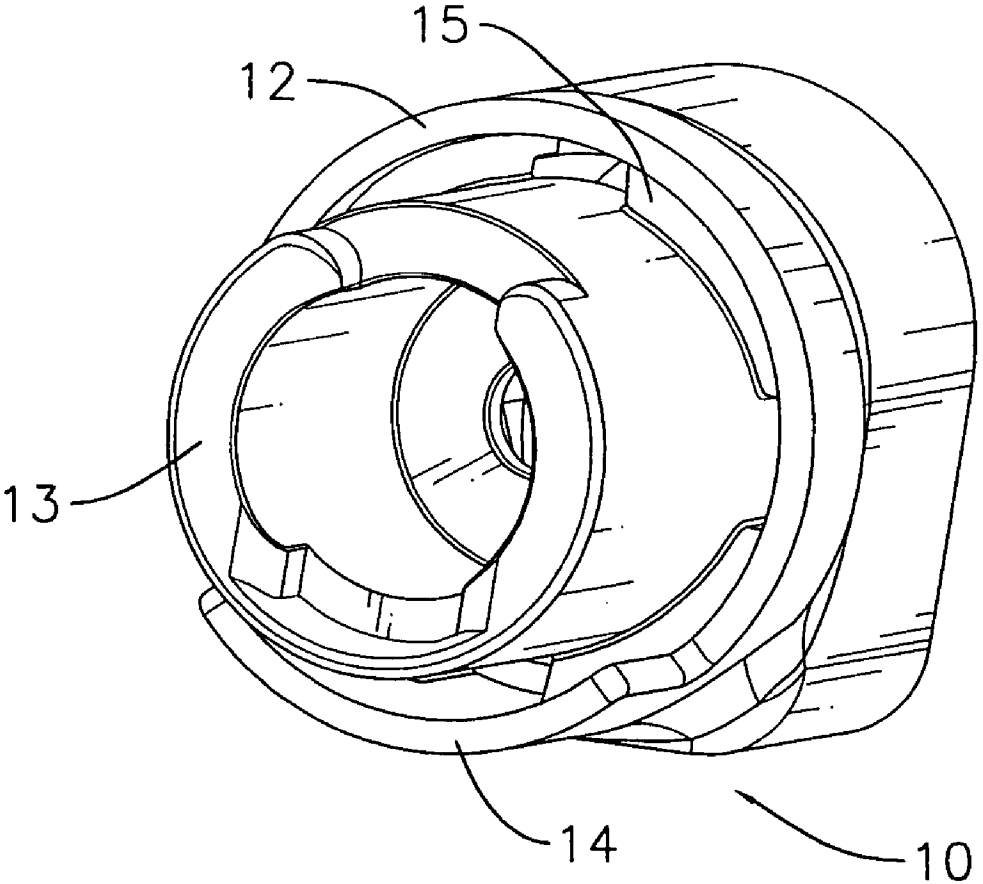
FIG. 5 is a perspective view of a lock base of the gate lock in FIG. 2.

With reference to FIG. 1, a gate (71) is mounted on a frame (72) that is mounted in a doorway. The gate (71) has a top rail with an end pivotally mounted on the frame (72), while a gate lock (not numbered) is mounted on an opposite end.

With reference to FIGS. 2-5, the gate lock is comprised of a lock base (10), a lock core (20) with a slot (21) defined therein, a latch member (30) and a bolt assembly (50).

The lock base (10) is a hollow cylinder with two ends and has a bottom and a top. The lock base (10) is mounted on an end of the top rail of the gate (71). A cylindrical protrusion (13) extends from one end of the lock base (10) and has multiple lugs formed at an end. An annular member (12) is formed around the protrusion (13) and has a stop (14) extending outward from an edge near the bottom of the lock base (10). A first curved rail (15) is defined along an inner wall of the annular member (12) in a space between the annular member (12) and the protrusion (13).

The lock core (20) is a hollow cylinder with an open end and a closed end. A vertical rectangular slot (21) is defined in the surface of the closed end of the lock core (20). A through hole (26) is transversely defined in the bottom of the slot (21) through the closed end of the lock core (20). A slope (22) is formed below the through hole (26). A cutout (24) is defined through a side of the lock core (20) at the upper end of the slot (21) and a tab (25) is formed at a surface of the lock core (20) opposite the cutout (24). An annular shroud (29) is formed around the lock core (20) at the open end. The annular shroud (29) forms a concentric depression around the lock core (20) by which the lock core (20) is rotatably mounted onto the annular member (12) of the lock base (10); The annular shroud (29) is discontinuous at the cutout (24) and forms sidewalls at two sides of the cutout (24), which limit the range of rotation of the lock core (20) when the stop (14) extending from the annular member (12) abuts either of the sidewalls. In addition, a tube (27) is axially formed in the lock core (20), and a second curved rail (28) is defined in a space between an inner wall of the lock core (20) and the tube (27) corresponding with the first curved rail (15).

The latch member (30) is a hollow cylinder with a serrated button (31) formed on a side of the latch member (30). The latch member (30) fits over the tube (27) with the button (31) exposed through the cutout (24). A tongue (32) is formed at an end of the latch member (30) and extends through the through hole (26) to act as a barrier between the slot (21) and the slope (22).

Figure 6:
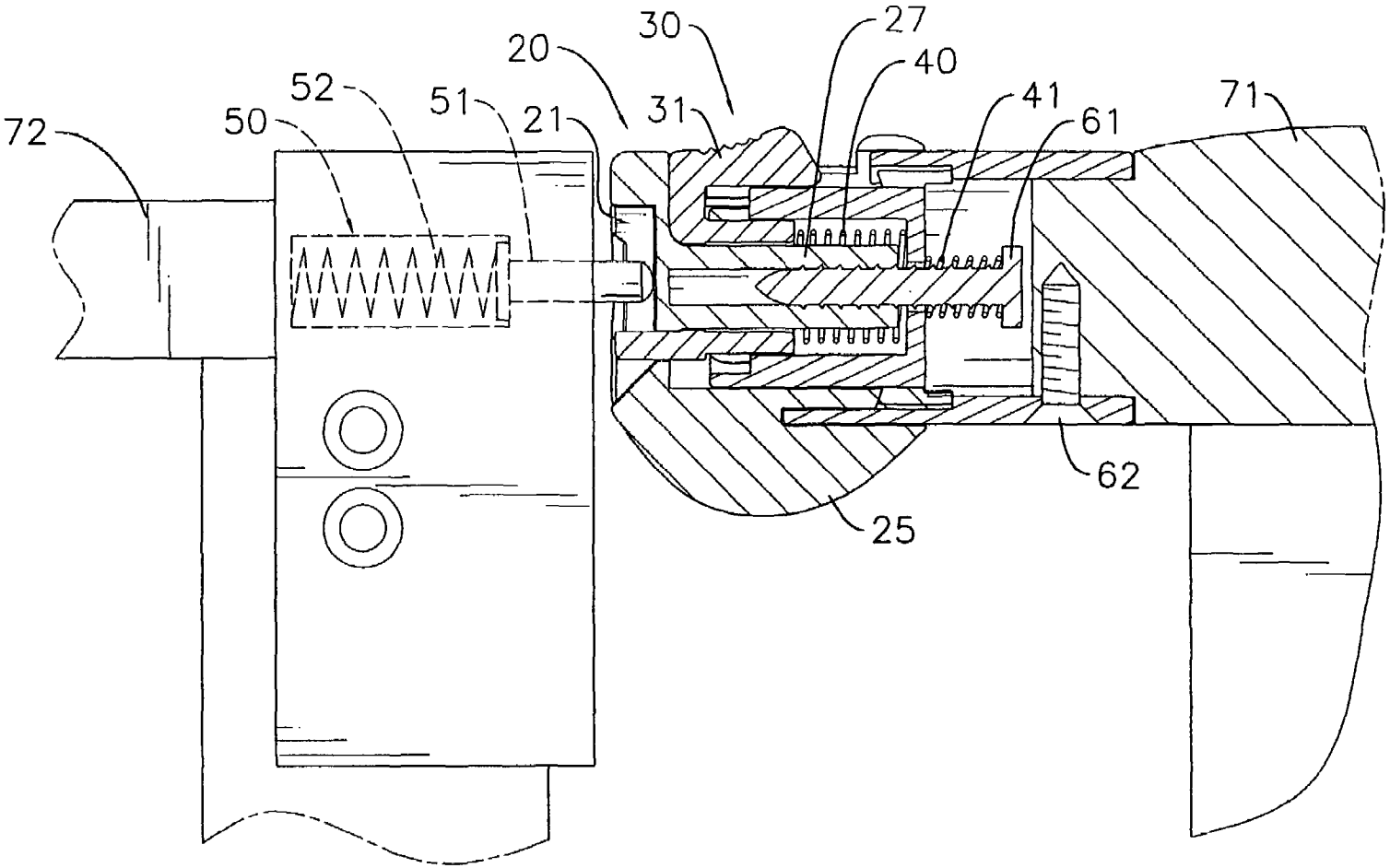
FIG. 6 is a cross-sectional side view of the gate lock in accordance with this invention.

With reference to FIG. 6, a first screw (61) is used to secure the lock core (20) to the lock base (10), and a second screw (62) secures the lock base (10) to the gate (71).

First and second springs (40,41) are fit over the tube (27) and the first screw (61), respectively.

The bolt assembly (50) is mounted on the frame (72) opposite to the lock core (20) and has a bolt (51) and a third spring (52). The third spring (52) biases the bolt (51) and causes the bolt (51) to extend into and be engaged in the slot (21) to lock the gate.

With reference to FIGS. 6 to 10, when the gate is to be closed, the button (31) is pulled back to draw the tongue (32) back into the lock core (20). The tongue (32) no longer acts as a stop between the slot (21) and the slope (22). The gate (71) is raised and then lowered over the bolt (51). The bolt (51) enters into the slot (21) along the slope (22); the button (31) is then released. The tongue (32), pushed by the first spring (40), extends back out through the through hole (26) to act as a stop between the slot (21) and the slope (22). The bolt (51) cannot draw back along the slope (22). Using the tab (25), the lock core (20) is then rotated 90 degrees. The slot (21) and the slope (22) also rotate 90 degrees to further stop the bolt (51) from escaping the slot (21). Meanwhile, as the lock core (20) is rotated, the high portion of the second rail (28) engages with the high portion of the first rail (15), which causes the lock core (20) to move outwards to further press on the bolt assembly (50). The latch member (30) is also stopped by the multiple lugs on the end of the protrusion (13). The button (31) cannot be pulled back to withdraw the tongue (26), so the bolt (51) remains trapped in the slot (21) to lock the gate (71) to the frame (72). In addition, when the lock core (20) is rotated 90 degrees, one of the sidewalls will abut the stop (14), thus stopping the lock core (20) from rotating more than 90 degrees.

Figure 8:
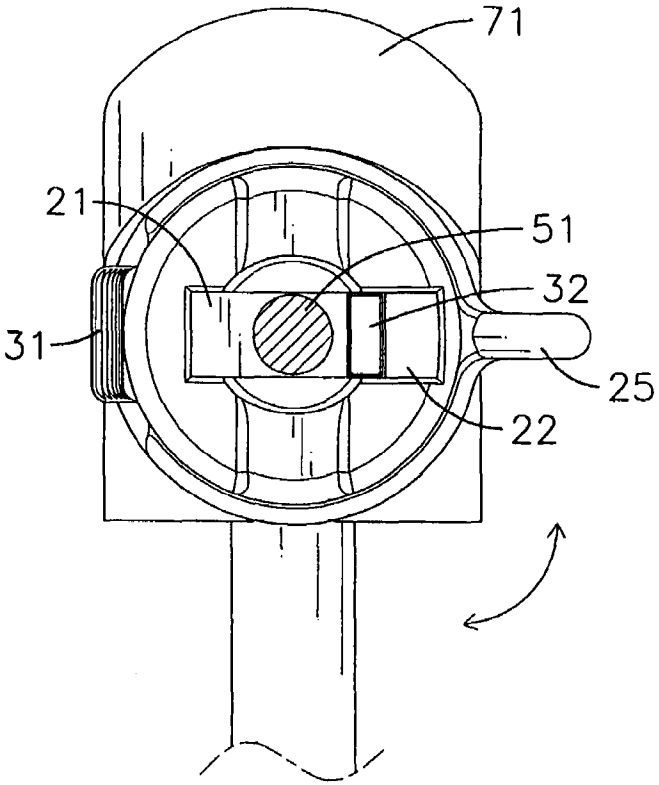
FIG. 8 is an end view of the lock core in FIG. 7 in another position.
Figure 7:
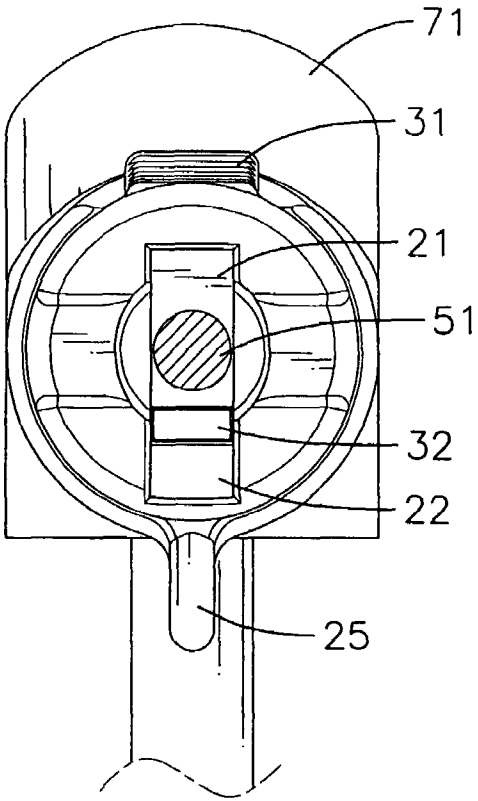
FIG. 7 is an end view of a lock core of the gate lock in FIG. 6.
Figure 9:
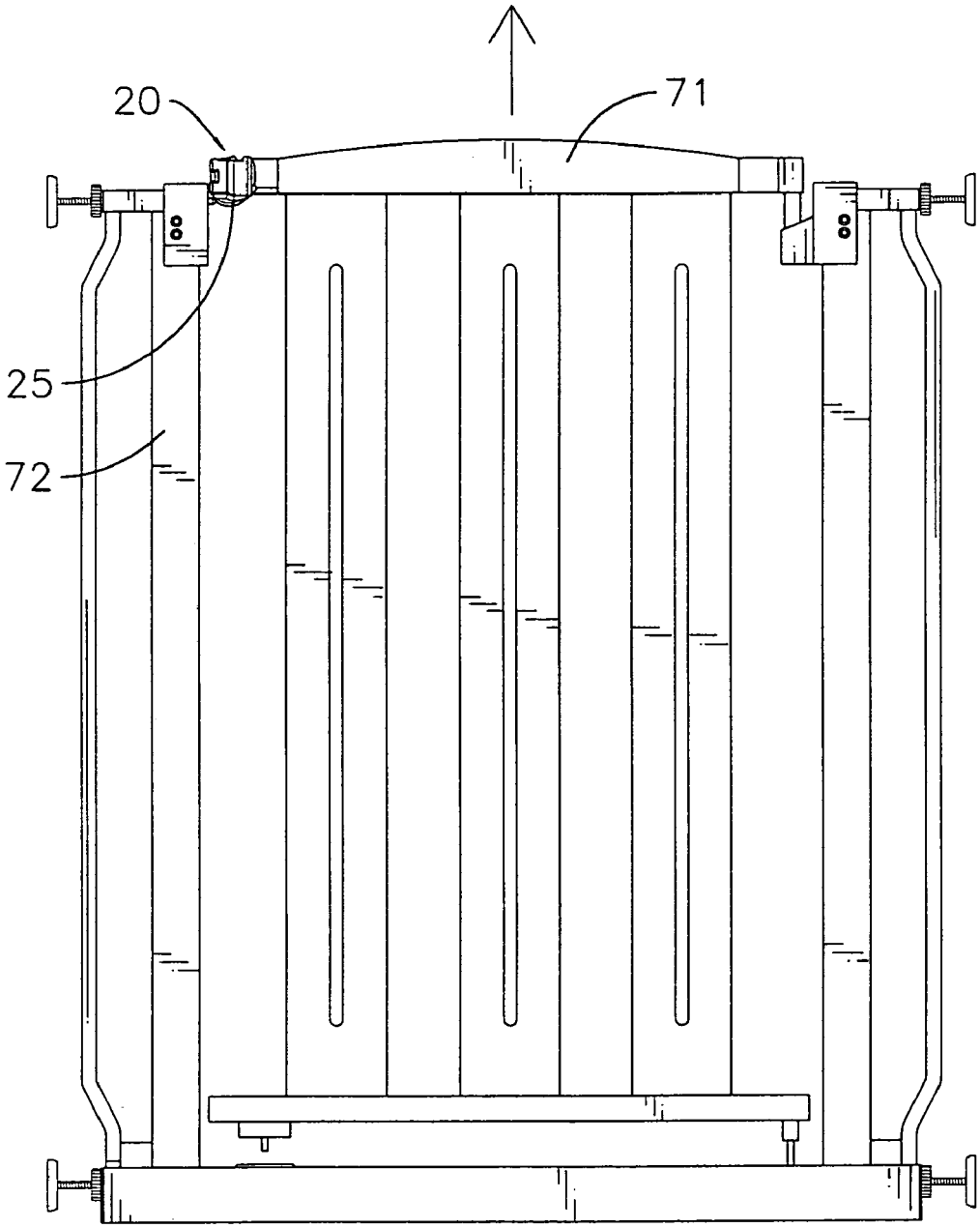
FIG. 9 is an operational front view of the gate lock in FIG. 1.
Figure 10:
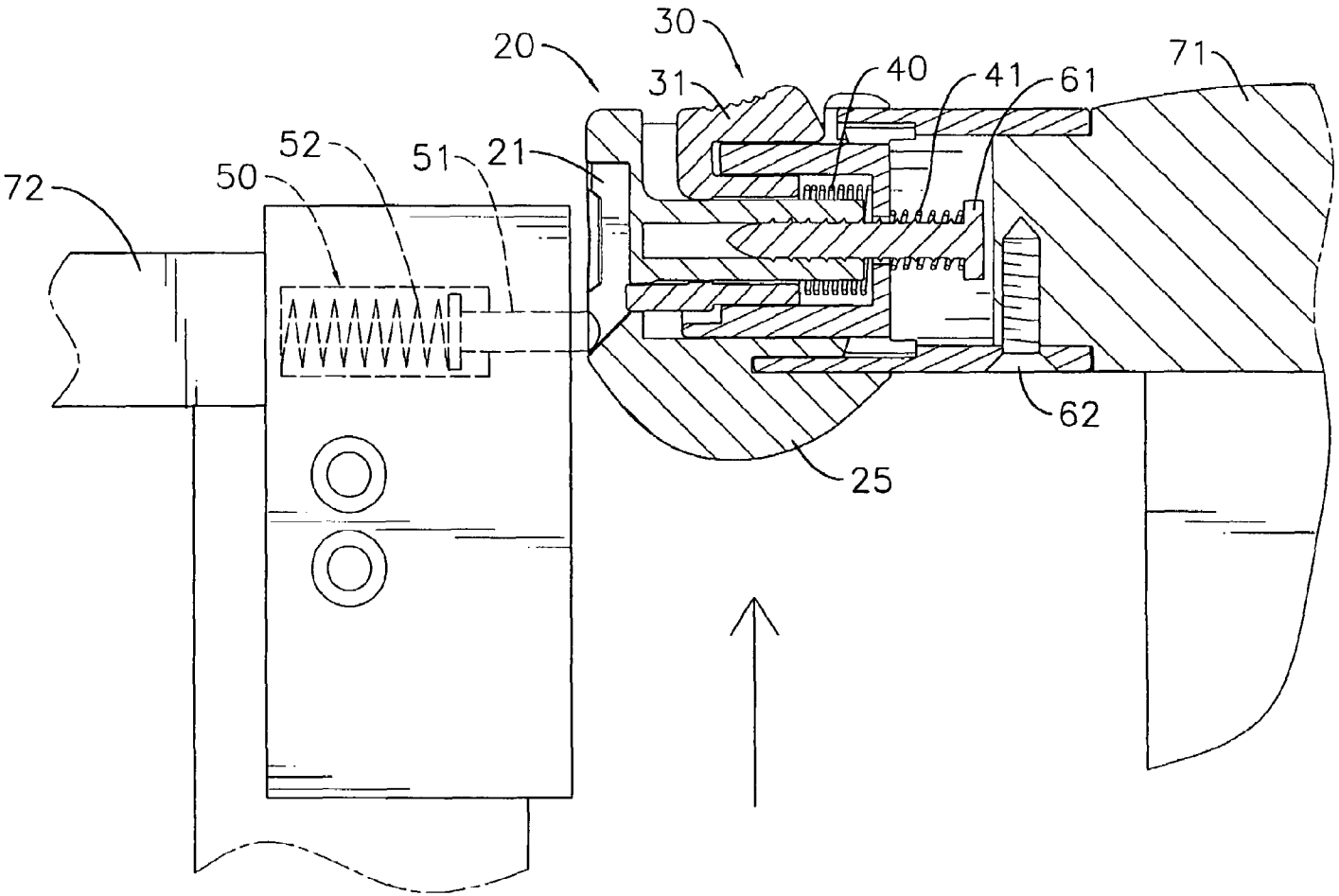
FIG. 10 is an cross-sectional side view of the gate lock in FIG. 6.

With reference to FIGS. 7-8, when the gate (71) is to be opened, the tab (25) and the lock core (20) is rotated 90 degrees in the opposite direction. The high portion of the second rail (28) engages the low portion of the first rail (15), causing the lock core (20) to draw back slightly. The slope (22) is again below the slot (26), and the button (31) can now be pulled back to retract the tongue (32) into the lock core (20). The gate (71) is raised and the bolt (51) slides out of the slot (21), thus allowing the gate (71) to be swung open. The latch member (30) will return to its original position due to the second spring (40).

Therefore, the gate lock of the present invention can be used to safely and securely lock a gate to prevent small children or pets from getting out.

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A gate lock comprising:

a lock base that is a hollow cylinder with an annular member extending from an end of the lock base;

a lock core that is a hollow cylinder with an open end and a closed end having a slot defined in the closed end, mounted on the annular member of the lock base;

a bolt assembly with a bolt extending in engagement with the slot and detachable therefrom;

a through hole being defined below the slot and a slope being formed below the through hole and a cutout being defined in a wall of the lock core;

a latch member being a hollow cylinder with a button formed on a side of the latch member, being located in the lock core with the button exposed through the cutout and having a tongue being formed at an end of the latch member and extending through the through hole in the lock core;

wherein the latch member is movable between a first position and a second position allowing the bolt to engage and detach from the slot.

2. The gate lock as claimed in claim 1, wherein a stop is formed on an edge of the annular member of the lock base, and an annular shroud is defined on the lock core, the annular shroud is discontinuous at the cutout, thus forming sidewalls on both sides of the cutout, and the stop is located in the shroud.

3. The gate lock as claimed in claim 2, wherein a tube is formed in the lock core over which the latch member is mounted.

4. The gate lock as claimed in claim 3, wherein a first spring fits over the tube.

5. The gate lock as claimed in claim 4, wherein a first curved rail is defined in an inner wall of the annular member.

6. The gate lock as claimed in claim 4, wherein a protrusion with multiple lugs is formed at inside the annular member at an end of the lock base.

7. The gate lock as claimed in claim 6, wherein the bolt assembly having a bolt supported by a third spring.

8. The gate lock as claimed in claim 7, wherein the lock base is secured to the lock core by a first screw.

9. The gate lock as claimed in claim 2, wherein a second spring fits over the first screw.

* * * * *